US005362273A

United States Patent [19]

Pfeiffer, Jr. et al.

[11] Patent Number: 5,362,273

[45] Date of Patent: Nov. 8, 1994

[54] VEHICLE EXHAUST DISTRIBUTION SYSTEM FOR BUILDINGS

[75] Inventors: Edward A. Pfeiffer, Jr., Warminster; Paul Hamilton, Levittown, both of Pa.

[73] Assignee: Exhaust Track, Inc., Warminster, Pa.

[21] Appl. No.: 183,554

[22] Filed: Jan. 19, 1994

[51] Int. Cl.[5] ..... B08B 15/00

[52] U.S. Cl. ..... 454/63; 454/903

[58] Field of Search ..... 104/52; 454/63, 64, 454/166, 167, 903

[56] References Cited

U.S. PATENT DOCUMENTS

| | | | |
|---|---|---|---|
| 3,473,462 | 10/1969 | Imming . | |
| 4,102,254 | 7/1978 | Grant . | |
| 4,233,889 | 11/1980 | Nederman . | |
| 4,259,897 | 4/1981 | Nederman . | |
| 4,312,645 | 1/1982 | Mavros et al. . | |
| 4,335,574 | 6/1982 | Sato et al. . | |
| 4,389,923 | 6/1983 | Ludscheidt . | |
| 4,567,817 | 2/1986 | Fleischer et al. . | |
| 4,660,465 | 4/1987 | Jentzsch et al. . | |
| 4,699,046 | 10/1987 | Bellieni . | |
| 4,762,054 | 8/1988 | Melville et al. . | |
| 4,796,520 | 1/1989 | Kramer, Jr. . | |
| 5,092,228 | 3/1992 | Pfeiffer, Jr. et al. | 454/63 |

FOREIGN PATENT DOCUMENTS

| | | | |
|---|---|---|---|
| 194609 | 9/1986 | European Pat. Off. | 454/64 |
| 3407549 | 12/1984 | Germany | 454/63 |

OTHER PUBLICATIONS

"Extraction Duct for Verticle Stack Exhaust Pipes CVSR-20", Filter Clean Corporation, Edison, N.J.

*Primary Examiner*—Harold Joyce

*Attorney, Agent, or Firm*—Caesar, Rivise, Bernstein, Cohen & Pokotilow, Ltd.

[57] ABSTRACT

An exhaust fumes distribution system for use within a structure adjacent to a space in which a vehicle having an engine coupled to a vertically oriented, open ended, exhaust stack is to be located to discharge exhaust fumes out of the structure. The system comprises an actuatable blower, an elongated guide tube, a collapsible conduit, and a wireless transmitter and receiver. The guide tube has a hollow interior and a slot extending therealong and is mounted horizontally above the space so that the slot extends from a first position adjacent an entrance to the structure to a second, remote position. The collapsible conduit is located within the guide tube and is coupled to the blower. The conduit has an end portion including an inlet opening and is biased into an extended position within the guide tube so that the inlet opening is located adjacent the first position to receive the open end of the stack through the slot. The conduit is collapsible so that the open end of the stack remains within the inlet opening in the conduit when the vehicle is moved in the structure from the first position to the second position. The wireless transmitter is arranged for actuating the receiver, which is coupled to the blower, so that upon operation of the vehicle's ignition switch the blower is actuated to vent fumes in the stack through the conduit and out of the structure.

19 Claims, 4 Drawing Sheets

FIG. 5
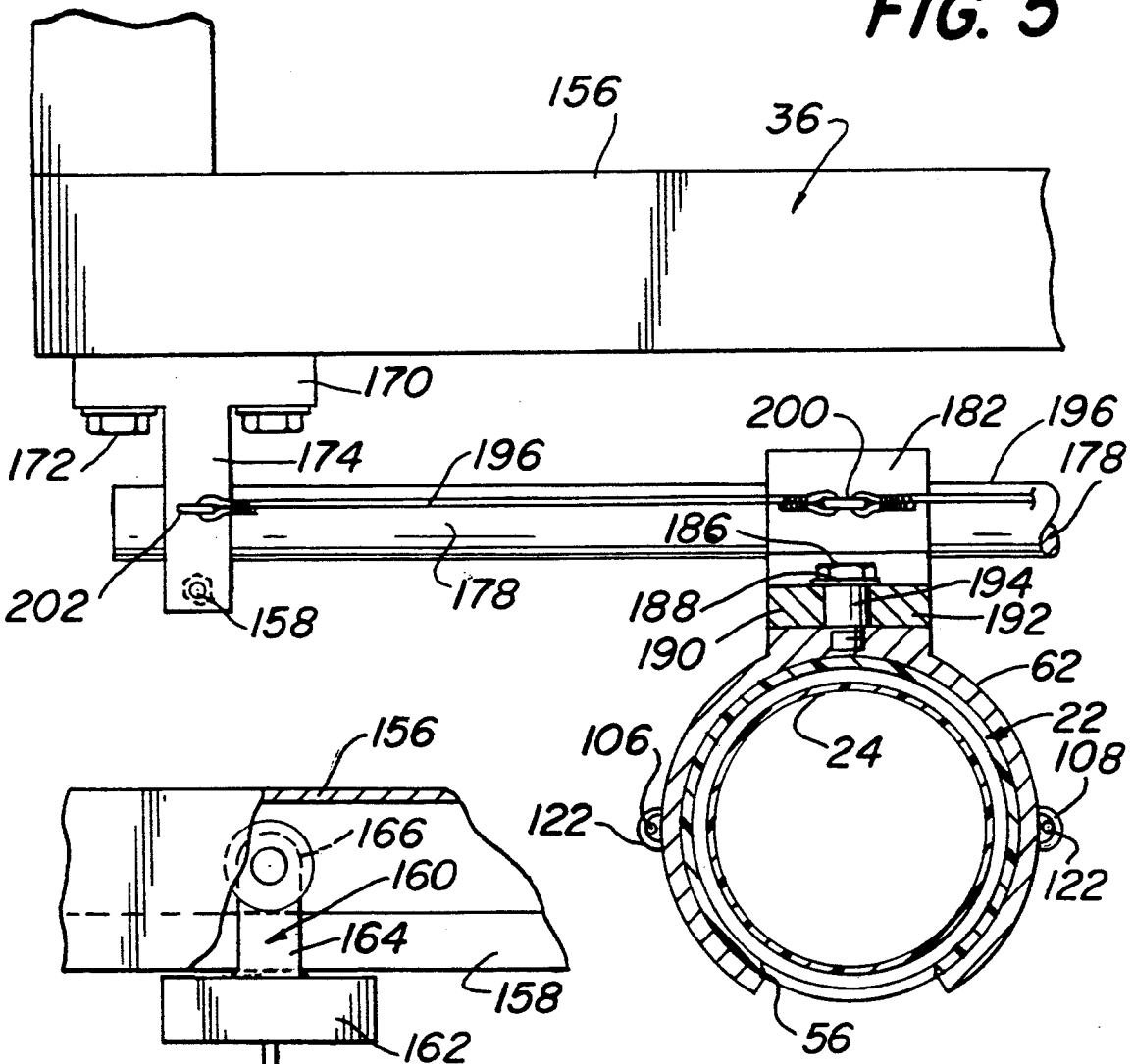
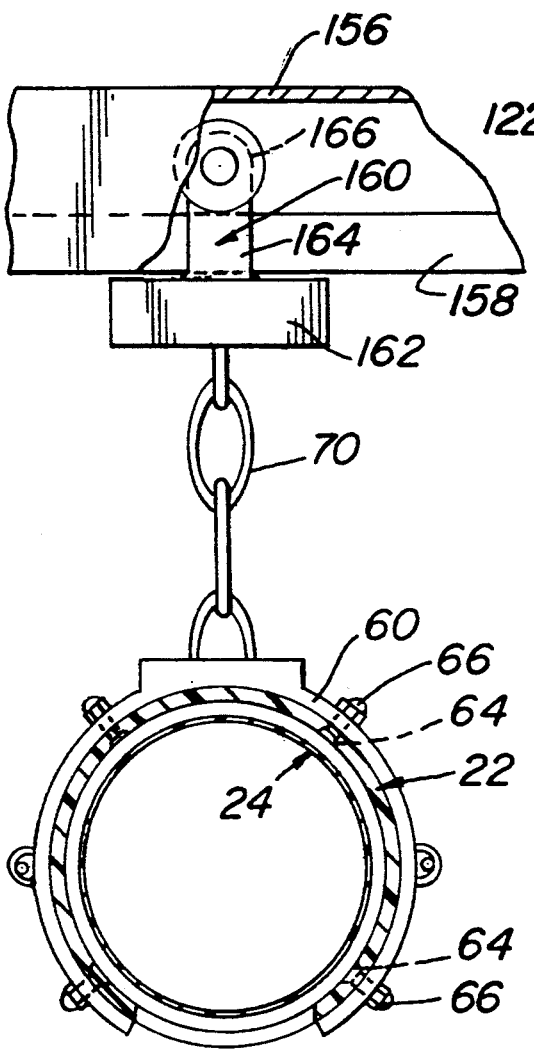
FIG. 6

VEHICLE EXHAUST DISTRIBUTION SYSTEM FOR BUILDINGS

BACKGROUND OF THE DISCLOSURE

This invention relates generally to exhaust distribution systems and more particularly to systems for exhausting fumes from motor vehicles having vertically oriented exhaust stacks which such vehicles are located within a building having the system in place.

The prior art includes many vehicle exhaust distribution systems for disposition in a building to vent exhaust fumes from automobiles, emergency vehicles, trucks and other vehicles while the vehicle is located therein. While these prior art systems may achieve their intended purpose of venting the exhaust fumes from the vehicle out of the building, they nevertheless suffer from one or more drawbacks. For example, many of these systems are quite complicated and involve many moving parts therefore making installation and maintenance very expensive. Further, many of these systems require manual connection and/or disconnection from the vehicle exhaust stack or tailpipe. Additionally, many of these systems require the placement of a special adaptor or cone over the open end of the vehicle exhaust stack in order to introduce the stack into the exhaust distribution system. Finally, many of these systems use seals, moldings or lips for containing exhaust fumes.

In particular, U.S. Pat. No. 3,473,462 (Imming) discloses an exhaust system wherein a flexible exhaust tube is telescoped when not in use within a rigid storage conduit suspended from the ceiling and communicating with an exhaust fan. The flexible exhaust tube is manually withdrawn from stored position by means of pulleys and cables. The outer end of the flexible exhaust tube is provided with an adaptor which is designed to be fitted over and connected to the end of the vehicle's exhaust pipe. Although the system provides a means for venting exhaust fumes from a tailpipe to the atmosphere outside the building, the above-mentioned drawbacks still appear to exist.

U.S. Pat. No. 4,102,254 (Grant) discloses an exhaust disposal system which includes conduit disposed in a trench below a garage floor which at one end has attached a flexible ribbed cup-like member which is designed to engage with the tailpipe of a vehicle. The conduit can be extended upwardly from the trench by means of a switch activated motor in a manner so that the flexible ribbed cup-like member can engage with the tailpipe of the vehicle and vent exhaust fumes to the outside atmosphere. Although this system provides a means for automatically engaging and disengaging the vehicle's tailpipe, several of the previously mentioned drawbacks still appear to exist. Specifically, this system requires the attachment of a special L-shaped tube to the tailpipe to facilitate engagement with the exhaust disposal system. Further, this system utilizes a moving conduit which is operated by motor consisting of several moving parts, such as a belt and gears.

U.S. Pat. No. 4,567,817 (Fleischer) discloses an exhaust-gas offtake track for exhausting fumes from a track-guided vehicle. The exhaust stack of the vehicle extends vertically into a collecting funnel. The funnel forms a portion of a trolley assembly to slide down the track and communicates with the interior of the track to carry fumes from the vehicle into the interior of the track for venting out of the building. This system also appears to have several drawbacks, namely, the necessity of attaching a collecting funnel to the top of a vertical exhaust stack prior to introducing the exhaust stack into the system, and the necessity to use sealing lips on the underside of the gas waste duct.

It is believed that Filterclean Corporation of Edison, N.J. offers an exhaust distribution system including a venting device for vehicles equipped with vertical exhaust stacks under the model designation VSR-20. It is believed that such a system is arranged for use with vehicles having a vertically extending exhaust pipe and includes a suction rail containing a slit on its bottom side to allow for the introduction of a vehicle's vertical exhaust stack into the exhaust disposal system.

This system is also believed to make use of two rubber sealing lips which run the length of the suction rail to prevent leakage of exhaust fumes to the interior of the structure. In addition, it is believed that the vehicle's vertical exhaust stack must be fitted with a special cone to allow smooth entry into the rubber seals underneath the suction rail.

Other devices which vent and/or trap exhaust fumes from a vehicle's exhaust stack or tailpipe are disclosed in U.S. Pat. No. 4,796,520 (Kramer), U.S. Pat. No. 4,660,465 (Jentzsch et. al.), U.S. Pat. No. 4,259,897 (Nederman), U.S. Pat. No. 4,233,889 (Nederman), U.S. Pat. No. 4,762,054 (Melville et. al), U.S. Pat. No. 4,699,046 (Bellieni) U.S. Pat. No. 4,389,923 (Ludscheidt), U.S. Pat. No. 4,312,645 (Mavros et al.) and U.S. Pat. No. 4,335,574 (Sato, et al.).

While the foregoing prior art systems may achieve their intended purpose, namely, venting the exhaust fumes from the vehicle out of the building, they nevertheless leave much to be desired from the various standpoints previously discussed.

In U.S. Pat. No. 5,092,228 (Pfeiffer)—which is hereinafter referred to as the '228 patent and of which I am a coinventor—there is disclosed and claimed an exhaust distribution system which overcomes many of the drawbacks of the prior art systems. Specifically, the exhaust distribution system of the '228 patent is arranged for use within a structure, e.g., a firehouse, adjacent a space in which a vehicle, e.g., a fire truck, having a vertically oriented, open ended, exhaust stack is to be located. The system basically comprises elongated track mounted horizontally below the ceiling or roof of the structure, a trolley slidably mounted on the track and including an inlet adapted to receive the open upper end of the vertical exhaust stack, a biasing assembly to position the trolley, a blower for venting fumes from the structure, a flexible hose connecting the inlet of the trolley to the blower, and a blower actuating switch for turning the blower when the vehicle's engine is on. The track supports the trolley for slidable movement therealong from a first position adjacent an entrance to the structure to a second position within the structure remote from the entrance and where the vehicle will be parked. The biasing assembly is arranged for automatically positioning the trolley means at the first position so that when the vehicle is driven into the structure the stack is automatically received within the inlet of the trolley and remains in the inlet while the vehicle is within the structure. The blower actuating switch is arranged to sense a predetermined pressure in the stack, thereby indicating that the vehicle's engine is running and exhaust fumes are being produced, to cause the blower to turn on, whereupon the exhaust fumes are drawn through the hose means and the blower to be vented out of the structure.

The system subject to the '228 patent overcomes many of the disadvantages of the prior art systems. For example, one advantage the '228 system has over the prior art is that it is arranged to automatically attach and detach to the open end of the vehicle's stack to discharge any exhaust fumes out of the structure. Therefore, the system does not require manual connection and/or disconnection from the vehicle exhaust stack or tailpipe as is necessary in some prior art systems. Moreover, many of the prior art systems require the use of a special adaptor or cone which is mounted on the open end of the vehicle exhaust stack in order to introduce the stack into the system. In the system of the '228 patent no special adapters or cones are used on the exhaust stack itself. Instead, the open end of the vehicle's exhaust stack enters directly into the mouth of a hose assembly which is supported by a trolley. Further, the prior art systems make use of sealing lips to prevent leakage of exhaust fumes to the interior of the structure. The system of the '228 patent is constructed to enable the open end of the exhaust stack to be fully contained within the inlet end of the hose as the vehicle is moved within the building so that the trolley is moved down the track by the movement of the vehicle.

While the system of the '228 patent overcomes many of the disadvantages of the prior art, it nevertheless still leaves something to be desired from several standpoints. For example, the trolley in the '228 patent is an assembly comprised of a box-like housing which hangs from a track by a pair of opposed rollers and is moveable between the ends of the track. In practice, because the trolley's weight is significant, it is necessary to control the trolley's speed as it travels forward upon a vehicle leaving the structure so as to prevent impact of the trolley with the front end of the track. Additionally, the exhaust blower of the '228 patent is activated in response to the sensation of increased pressure within the system as occasioned by the existence of exhaust fumes in the stack. As will be appreciated by those skilled in the art, at start-up, many diesel engines produce a great deal of smoke. Thus, a pressure activated exhaust blower, such as that used in the '228 patent, may not respond quickly enough to remove that smoke.

OBJECTS OF THE INVENTION

It therefore is a general object of this invention to provide an exhaust distribution system which overcomes the disadvantages of the prior art.

It is also an object of this invention to provide an exhaust distribution system which is an improvement over the exhaust distribution system described in U.S. Pat. No. 5,092,228.

It is also an object of this invention to provide an exhaust distribution system which does not require manual connection or disconnection to the vehicle.

It is also an object of this invention to provide an exhaust distribution system which does not require the placement of a special adaptor or cone over the open end of the vehicle exhaust stack in order to utilize the exhaust distribution system.

It is also an object of this invention to provide an exhaust distribution system which does not make use of seals, moldings or lips for containing exhaust fumes.

It is also an object of this invention to provide an exhaust distribution system which provides greater air flow potential for more efficient removal of exhaust fumes.

It is another object of this invention to provide an exhaust distribution system for automatically connecting to a vertical stack of a vehicle when the vehicle is within a structure in which it may be operated.

It is another object of this invention to provide an exhaust distribution system which automatically vents exhaust fumes out of a building in which it is located when the motor of the vehicle is operating.

It is another object of this invention to provide an exhaust distribution system which is comprised of fewer moving parts.

It is another object of this invention to provide an exhaust distribution system which eliminates the need for a heavy trolley which moves along tracks.

It is another object of this invention to provide an exhaust distribution system which is simpler and less expensive to construct and install.

It is a further object of this invention to provide an exhaust distribution system which is simple to maintain.

SUMMARY OF THE INVENTION

These and other objects of this invention are achieved by providing an exhaust fumes distribution system for use within a structure adjacent to a space in which a vehicle having an engine coupled to a vertically oriented, open ended, exhaust stack is to be located to automatically attach/detach to the open end of the stack to discharge exhaust fumes from the vehicle out of the structure.

In accordance with one aspect of the invention the exhaust fumes distribution system comprises actuatable venting means, an elongated guide tube, collapsible conduit means, and actuating means. The actuatable venting means is arranged when actuated to vent the exhaust fumes out of the structure. The elongated guide tube has a hollow interior with a slot extending therealong and in communication with the hollow interior. The guide tube has a longitudinal axis and is mounted horizontally above the space so that the slot extends parallel to the axis from a first position adjacent an entrance to the structure to a second position within the structure remote from the entrance. The slot enables the exhaust stack to be extended therethrough so that the open end is within the hollow interior.

The collapsible conduit means is located within the elongated guide tube and is coupled to the venting means. The collapsible conduit means has an end portion including an inlet opening and is biased into an extended position within the guide tube so that the inlet opening is located adjacent the first position to receive the open end of the stack therein. The conduit is collapsible so that the open end of the stack remains within the inlet opening in the collapsible conduit means when the vehicle is moved in the structure from the first position to the second position. The actuating means is arranged for actuating the venting means, whereupon the venting means vents fumes within the exhaust stack through the conduit means out of the structure.

In accordance with another aspect of the invention the actuable venting means of the exhaust fumes distribution system is arranged for actuating the venting means to vent fumes in the exhaust stack through the conduit means out of the structure responsive to the operation of the vehicle's ignition switch.

DESCRIPTION OF THE DRAWINGS

Other objects and many attendant features of this invention will become readily appreciated as the same becomes better understood by reference to the following detailed description when considered in connection with the accompanying drawing wherein:

FIG. 5 is an enlarged, sectional view taken along line 5—5 of FIG. 4 and,

FIG. 6 is an enlarged, sectional view taken along line 6—6 of FIG. 4.

DETAILED DESCRIPTION OF THE PREFERRED EMBODIMENTS

Figure 1:
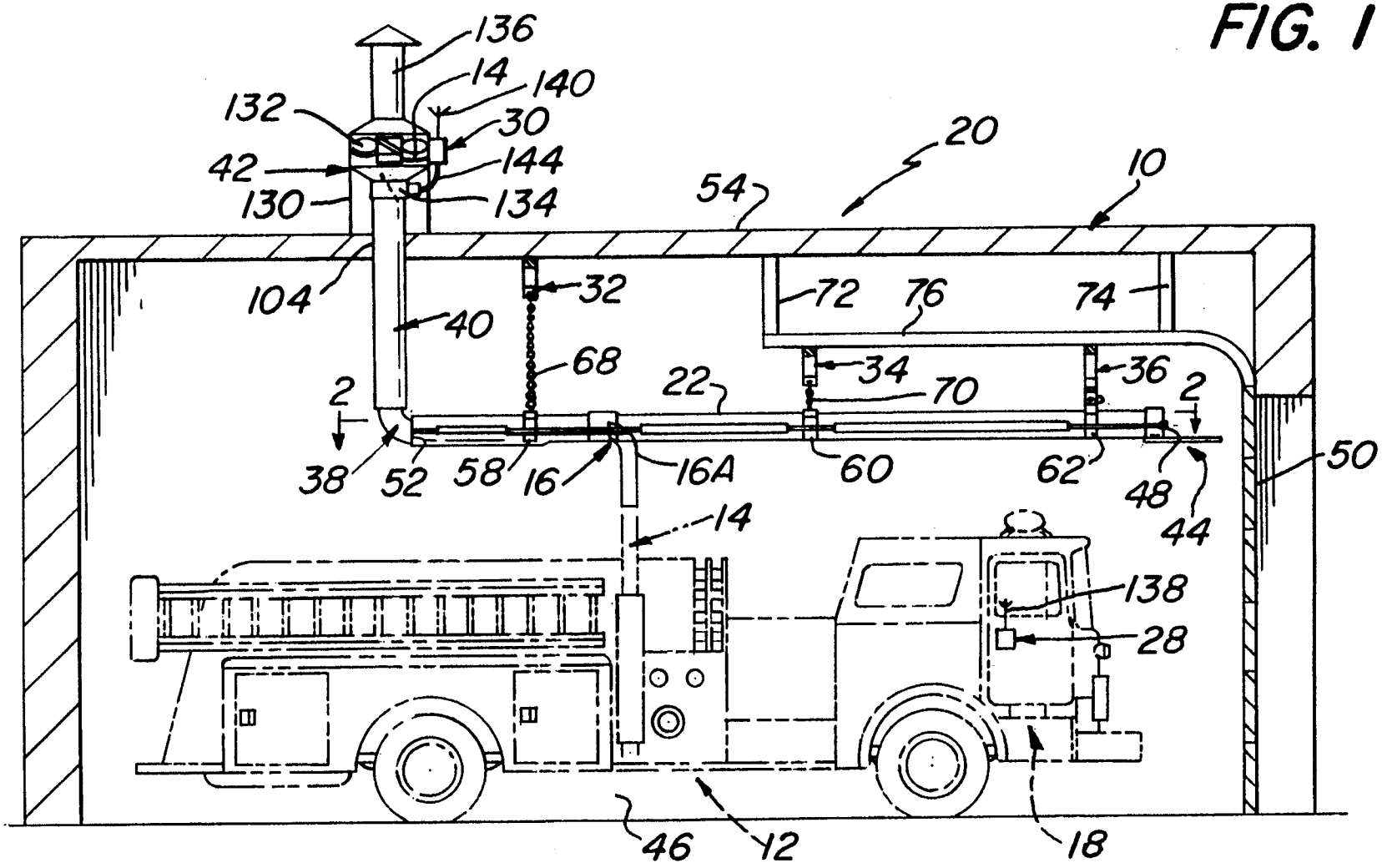
FIG. 1 is a side elevation view, partially in section, showing the system of the present invention mounted within a building for venting exhaust fumes from a vehicle (shown in phantom lines) located therein.

Referring now to various figures of the drawings where like reference numerals refer to like parts, there is shown at 20 in FIG. 1, an improved exhaust distribution system constructed in accordance with this invention.

The details of the system 20 will be described later. Suffice it for now to state that the improved exhaust distribution system 20 is arranged to be mounted within a building 10 or any other structure in which a vehicle 12 having a petroleum, e.g., gasoline or diesel, burning engine (not shown) is to be located and operated. The system 20 is so arranged to automatically cooperate with the vehicle's exhaust stack to vent any exhaust fumes produced by the vehicle's engine out of the building- In particular, the system 20 includes means to automatically couple itself to the vehicle's exhaust system stack whenever the vehicle is moved into the building to a first position adjacent the building's entrance or door and to remain coupled thereto when the vehicle is moved further back into the building to its normal parking location or bay and to remain coupled thereto when the vehicle is moved from the bay until the vehicle is out of the structure. Moreover, the system includes means which automatically senses when the vehicle's ignition system is activated to cause the system to operate to vent the vehicle's exhaust fumes out of the building to the ambient surroundings.

In the embodiment of the invention shown herein, the vehicle 12 is a conventional fire truck (shown in phantom in FIG. 1) and has a vertically disposed exhaust stack 14. The upper end of the stack curves to a horizontal orientation and terminates in an open end 16. As is conventional, the vehicle includes an ignition system 18 having at least one actuating button, shown schematically in FIG. 1, which when actuated causes the vehicle's engine to commence operation. It should be pointed out at this juncture that the specific vehicle shown herein is merely exemplary of any type of vehicle having a vertically oriented exhaust stack for which the subject invention has utility. Moreover, it is to be understood that the subject invention can be used in any type of structure to vent exhaust fumes from any such vertical-exhaust-stacked vehicle disposed therein.

As can be seen in FIGS. 1, 2, 3 and 4, the system 20 basically comprises an elongated guide tube 22, a collapsible hose 24 housed therein, a biasing assembly 26, an electrical control signal transmitter 28, an electrical control signal receiver 30, a pair of track slides 32 and 34, a bearing slide 36, a coupling elbow 38, a vent hose 40, a vent assembly 42, and a stack entrance guidance assembly 44.

The system 20 is mounted in the building so that its hollow guide tube 22 extends longitudinally along the space or bay 46 in which the vehicle 12 is to be parked so that the open end 16 of the vehicle's exhaust stack can enter the guide tube and move freely therein as the vehicle 12 is moved further within the bay until it is in its desired parking space within the bay, e.g., at the rear of the building as shown.

Figure 2:
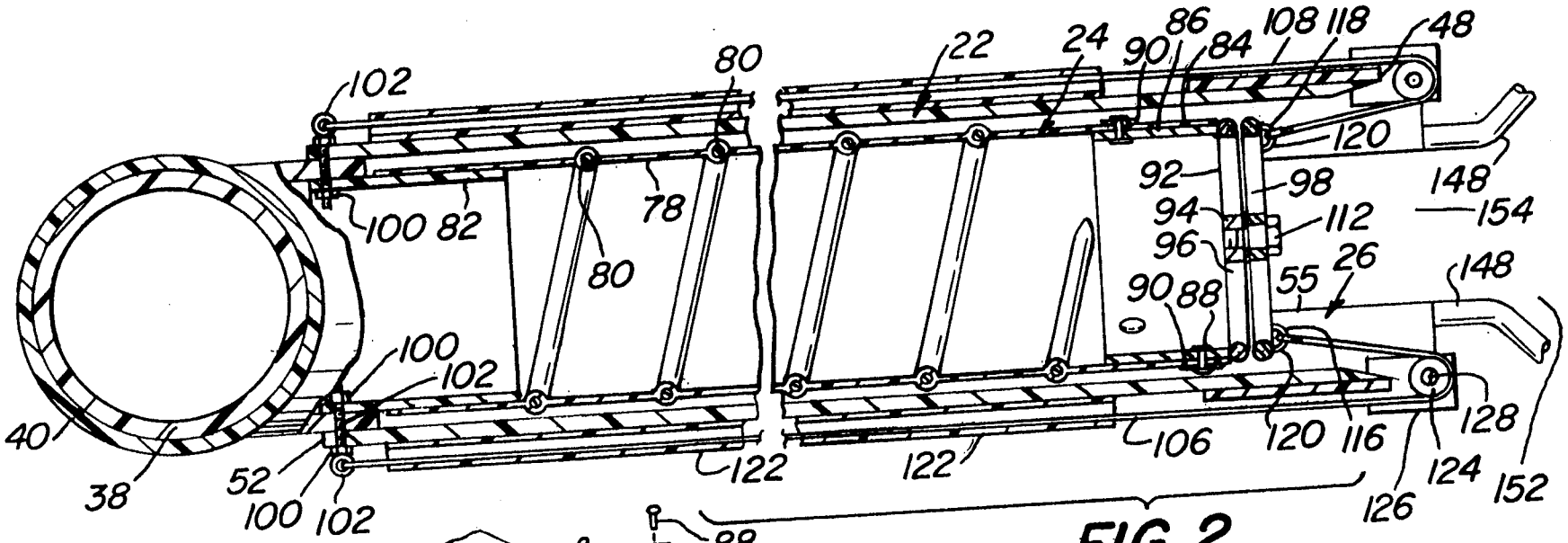
FIG. 2 is an enlarged, sectional view in taken along line 2—2 of FIG. 1.

As shown in FIGS. 1 and 2, the guide tube 22 is comprised of an open front end 48 situated at a point adjacent to the entrance 50 of the building and a rearward end 52 which is situated at a point further into the building, e.g., near the building's rear wall. The guide tube 22 is mounted by the slide assemblies to be described later so that it is suspended to extend horizontally below the roof or ceiling 54 of the building and immediately to the side of the bay 46. The length of the guide tube 22 is dependent on the vehicle, the garage length, the distance from the entrance to the garage to the bay at which the vehicle is to be parked, etc. Accordingly, the length of the guide tube assembly can be selected as desired for the application.

Figure 3:
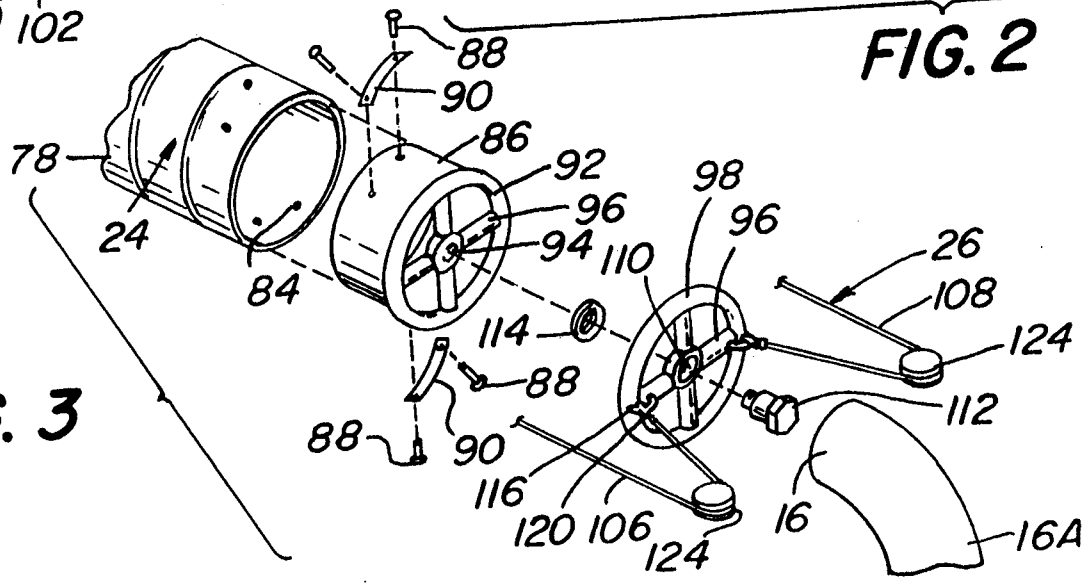
FIG. 3 is an enlarged, exploded isometric view of a portion of the system shown in FIG. 1.
Figure 4:
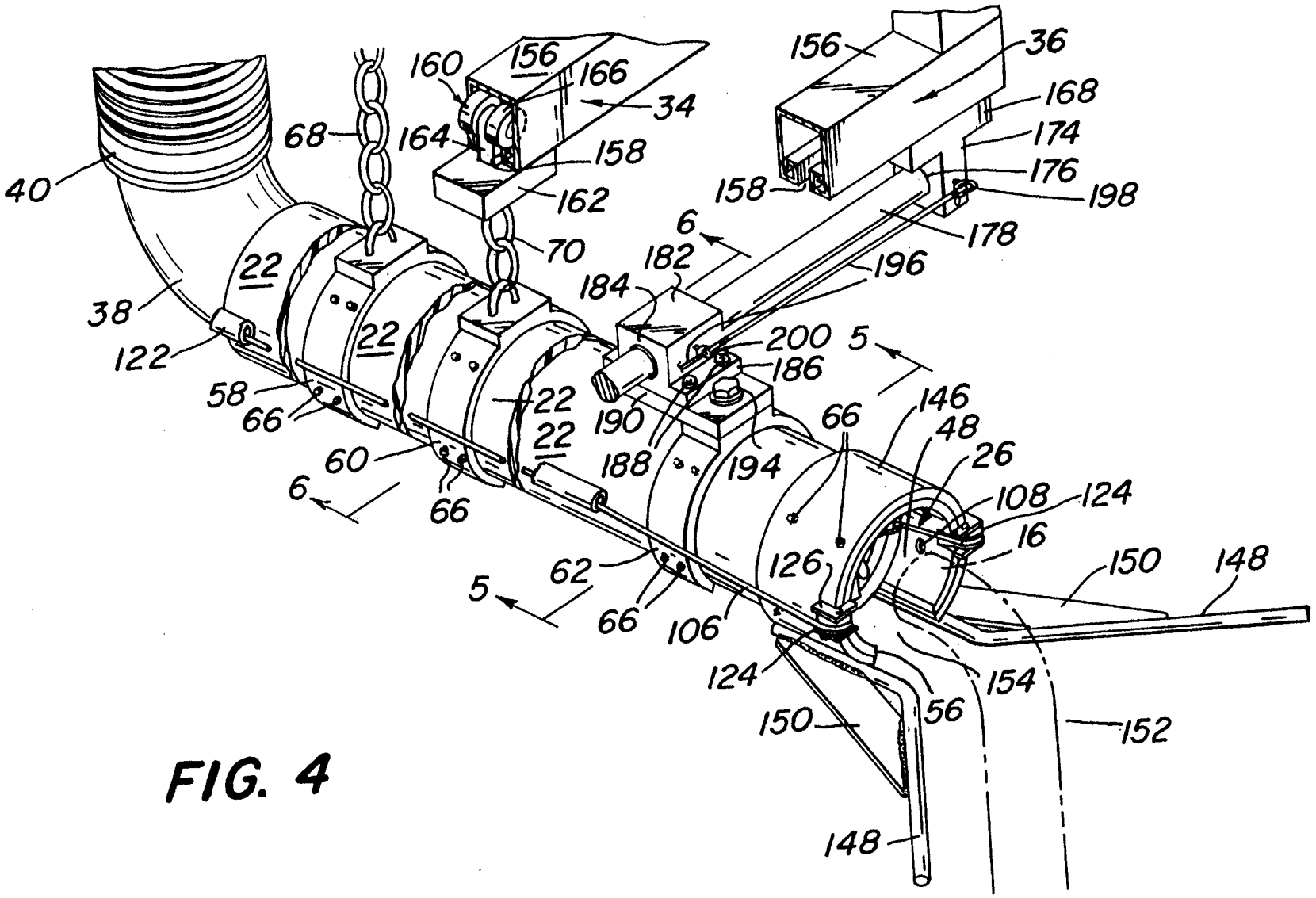
FIG. 4 is an enlarged, isometric view, partially in section, of a portion of the system shown in FIG. 1.

As shown in FIG. 4, the guide tube 22 is a rigid hollow structure that is formed of any suitable material, e.g., aluminum, steel or any hard plastic, such as polyvinylchloride. In the embodiment shown herein, the guide tube has a circular cross-section. It is important that guide tube 22 have a sufficiently large internal diameter to house the collapsible hose 24. As will be described later, the collapsible hose includes an open end arranged to receive and cooperate with the open end 16 of the exhaust stack 14 to receive exhaust fumes therefrom. The collapsible hose is guided within the guide tube 22. In one exemplary embodiment, the guide tube has an inner diameter of at least 10 inches (25.4 cm). As shown in FIGS. 2 and 4, guide tube 22 includes a slot 56 which is of uniform width and runs longitudinally along the underside of guide tube 22 from open front end 48 to a point adjacent the rear end of the guide tube. The length of slot 56 can be selected as desired for the application to permit free movement of exhaust stack 14 through guide tube 22 so as to enable vehicle 12 to be situated in bay 46 as shown in FIG. 1. The curved upper end 16 of the vehicle's exhaust stack 14 is arranged to enter the open end 48 of the guide tube, while the vertically extending portion 16A (FIGS. 1 and 3) of the stack contiguous with the open end 16 enters into the slot 56 so that as the vehicle moves down the bay the exhaust stack 14 can slide within the slot 56. The width of slot 56 is determined by and must be slightly larger than the outer diameter of the exhaust stack so that the exhaust stack can freely travel therethrough. In the embodiment shown, slot 56 is at least $5\frac{1}{4}$ inches wide (13.3 cm).

The guide tube 22 with the collapsible tube 24 located therein is supported below the building's roof and to the side of the bay by support brackets 58, 60 and 62 and the heretofore identified slides 32, 34 and 36. As shown in FIGS. 1, 4 and 6, the support brackets 58, 60 and 62 each comprise a hollow ring. Each is fixedly secured to the outer surface of guide tube 22 by any suitable means, e.g., the use of plural flat head screws 64 (FIG. 6) and associated nuts 66 (FIGS. 4 and 6) oriented as shown in FIG. 6. The securing hardware must be installed in a manner to avoid interference with the movement of collapsible hose 24 within the guide tube 22 (as will be described later). The support brackets are formed of any suitable material, e.g., aluminum, stainless steel or a hard plastic, and serve to suspend the guide tube 22 at points along its length so that the guide tube is horizontally disposed. Each of the support brackets, is in turn suspended either directly or indirectly from the roof by an associate support chain. For example, the bracket 58 is supported by a support chain 68 connected to the track slide 32. The support bracket 60 is suspended by a support chain 70 which is connected to the track slide 34. The support bracket 62 is suspended directly from the bearing slide 36 without using any support chain.

In addition to suspending the guide tube 22 below the roof, the track slides 58 and 60 and the bearing slide 62 also allow the guide tube to move in lateral directions, i.e., perpendicular to the longitudinal axis of the guide tube for the purpose of aligning the guide tube with a vehicle's exhaust stack. The track slide 32 is mounted directly to the roof or ceiling 54 of the building 10 by any conventional fastening means (not shown). The track slide 34 and the bearing slide 36 are mounted on the ceiling via a mounting assembly comprising a pair of vertical support bars 72 and 74 and a horizontal bar 76.

As shown in FIG. 1, the vertical support bars 72 and 74 are fixedly secured to roof 54 by any conventional fastening means and extend downward to a point in bay 46 where they connect with the horizontal support bar 76. The bearing slide and track slide are suspended from horizontal support bar 76 in the bay 46 using any suitable conventional fastening means (e.g., bolts, washers and nuts).

The suspension of guide tube 22 in bay 46 minimizes potential interference with the system 20 during use or when the vehicle 12 is absent and the bay 46 is used for other purposes.

As can be seen clearly in FIG. 2, the collapsible hose 24 is disposed inside the guide tube 22. As mentioned earlier, the purpose of collapsible hose 24 is to receive the open end 16 of exhaust stack 14 as it enters the open front end 48 of the guide tube to receive exhaust fumes from the exhaust stack. The collapsible tube is connected to the vent assembly 42 via the elbow 38 and the venting hose 40 to carry the exhaust fumes from the hose to the vent assembly. That assembly, as will be described later, vents the fumes out of the building.

As can be seen in FIGS. 2, 3 and 4, the collapsible hose 24 is comprised of a flexible hose fabric 78 and a supporting helical (spiral) coil 80. The far end of the hose is fixed in place within the guide tube by a cylindrical metal sleeve 82. The sleeve 82 is fixedly secured within the inner end of the hose fabric. The opposite end of the hose 24 is open and forms an inlet opening 84 in which a metal duct sleeve 86 is fixedly secured by rivets 88 and associated mounting strips 90 (FIGS. 2 and 3). An inner ring member 92 is welded to the end of the duct sleeve 86. The inner ring member includes a hub 94 supported by radially extending spokes 96. The inner ring is connected to an outer or floating ring 98, whose details will be described later, for connection to the biasing assembly 26.

The sleeve 82 at the inner end of the collapsible hose 24 is fixedly secured to guide tube 22 and the elbow 38. Specifically, as shown in FIG. 2, the sleeve 82 is fixedly secured within the collapsible hose so that a portion of the sleeve is within the hose and a portion of the sleeve protrudes out from the hose. The inner portion of sleeve 82 is fixedly secured to the inside wall of collapsible hose 24 by any suitable means, i.e., a rivet (not shown), through hose fabric 78. The outer or exposed portion of sleeve 82 is fixedly secured to the elbow 38 and the guide tube 24 by nuts 100 and associated eyelet bolts 102. Spacers (not shown), may be provided, if necessary.

It should be pointed out at this juncture that the exposed portion of sleeve 82 can also be connected to a flexible hose (not shown) or rigid pipe (not shown) depending on the location of venting assembly 42 (to be described later.

As shown in FIGS. 1 and 2, the elbow 38 is constructed of any suitable material, e.g., sheet metal or a hard plastic, and is in communication with the vent hose 40. The elbow is connected to the vent hose by means of conventional hose clamps (not shown). The vent hose 40 basically comprises an elongated flexible tube formed of any suitable material, e.g., plastic, rubber, etc., and may be either smooth walled or corrugated. As can be seen in FIG. 1 the upper end of the vent hose 40 extends through an opening 104 in the roof or ceiling 54 of the building 10 to communicate with the vent assembly 42 located thereon.

In accordance with a preferred embodiment of this invention, the hose fabric 78 is impregnated with a heat resistant material to be capable of resisting high temperatures (e.g., up to 400° F.) created by the exhaust fumes emitted into system 20 from the exhaust stack 14. The helical coil 80 of the hose 24 is constructed of any suitable material, e.g., aluminum stock, and is preferably in the form of a continuous channel of U-shaped cross section (not shown). In forming the coil 80, the opening of the U-shaped channel faces inward toward central longitudinal axis of the coil. The hose fabric 78 is attached to the coil 80 by crimping the U-shaped coil to trap portions of the hose fabric 78 therein.

It should be understood by those skilled in the art that because coil 80 is of helical (spiral) construction, the collapsible hose 24 has the ability to extend and collapse along its length while located inside the guide tube 22. As shown in FIGS. 2 and 3, when collapsible hose 24 is in the fully extended position, with its free inlet opening 84 adjacent the open front end 48 of hollow guide tube 22, the collapsible hose 24 is the to be in the "ready" position since it is ready to be engaged by the open end 16 of the vehicle's exhaust stack when the vehicle is backed into the building. When the collapsible hose 24 is in the fully collapsed position after a vehicle's exhaust stack has entered the guide tube and the vehicle is driven deeply into the bay to its parking space, as shown in FIG. 1, the collapsible hose is said to be in the retracted position.

A sufficient amount of excess hose fabric 78 is provided between each coil of the helical coil 80 to allow the coils to separate from one another to allow the collapsible hose 78 to extend to its desired maximum length. It should be understood that when the collapsible hose is in the retracted position, the hose fabric 78 located between the coils folds inwardly upon itself, thereby reducing somewhat the inside diameter of the collapsible hose.

Since collapsible hose 24 is comprised of a helical or spiral coil 80 that is fixed at one end via the sleeve 82, the opposite end, i.e., the free inlet opening 84 will rotate somewhat with respect to the central longitudinal axis of the hose 24 as it moves from ready position to retracted position and back again. Such rotation is accommodated by the biasing assembly 26 (as will be described later).

The biasing assembly serves to pull the collapsible hose to the ready position. This action ensures that when the vehicle is backed into the bay that the collapsible hose will be in ready position to receive the exhaust stack and will stay in communication with the exhaust stack as the vehicle is backed into its parking space within the bay. In addition, the biasing means ensures that the collapsible hose stays in communication with the exhaust stack as the vehicle is driven out of the building.

The details of the biasing means will be described later. Suffice it for now to state that such means includes a pair of elastic bungee cords 106 and 108 to effect the movement or biasing of the free end of collapsible hose 24 from the retracted position to the ready position. Since the hose 24 tends to rotate somewhat during expansion and contraction, as mentioned earlier, it is necessary to isolate the bungee cords 106 and 108 from the rotational effect to prevent them from becoming entangled during operation. This isolation action is accomplished by means of the floating ring 98. That ring is secured to the inner ring 92 and is free to rotate with respect thereto. The front or floating ring 98 is of similar construction to the inner ring 92 and thus includes a central hub supported by plural spokes 96. The central hub includes a smooth bore 110. The bore is arranged to receive the smooth shank of a bolt 112 therethrough. The bolt includes a threaded end for threaded engagement with a nut (not shown) to secure the floating ring to the inner ring and to enable the inner ring to rotate with respect to the floating ring about the axis of the bolt 112. To that end the shank of the bolt extends through a smooth opening in the hub 94 and the nut (not shown) is screwed onto the threaded end of the bolt to complete the rotary connection. A spacer 114 is interposed between the two rings. This mounting arrangement permits the floating ring 98 to be isolated from the rotation of the collapsible hose, i.e., the floating ring does not rotate, as the compressible hose travels from the ready position to the retracted position and back again.

The bungee cords 106 and 108 are releasably secured to eye-loops 116 and 118 on the floating ring 98 by suitable means, e.g., hooks. Thus, since the floating ring will not rotate as the collapsible hose rotates upon its expansion and contraction the attached bungee cords will not twist up or entangle. Further, since the bungee cords 106 and 108 will be in tension (as will be described later) when they are connected to the eye-loops 116 and 118 on front floating ring 98 this factor will further lessen the chance of any cord entanglement.

The details of the biasing assembly will now be discussed with reference to FIGS. 2, 3 and 4. Thus, as can be seen, that assembly basically comprises the bungee cords 106 and 108 mentioned previously and some additional components. The bungee cords are of conventional construction and are formed of any strong, yet resilient material. The bungee cord 106 is attached at its far end by a hook (not shown) extending through the eyebolt 102. As discussed earlier, the eyebolt 102 is fixedly secured to the guide tube 22 at its rearward end.

The bungee cord 106 extends through several horizontally disposed pipe segments 122 fixedly secured to the outer surface of the guide tube 22 by suitable means, e.g., straps (not shown). The pipe segments are purposely segmented so as to prevent interference with the support brackets 58, 60 and 62. The front end portion of the bungee cord 106 extends about a horizontally mounted pulley 124 and is secured to the eye-loop 116 on front ring 98 by the heretofore identified hooks 120. The pulley 124 is mounted on a flange 126 (to be described later) by means of a shaft 128. The pulley 124 should be oriented with respect to open front end 48 of guide tube 22 in a manner such that when bungee cord 106 is disposed around the pulley it will not become frayed or torn as the result of contacting the edges associated with open front end of the guide tube as the collapsible hose 24 moves from the ready position to the retracted position and vice versa.

The bungee cord 108 is mounted on the guide tube 22 and connected to the collapsible tube 24 in the same manner as the bungee cord 106 and thus the details of that mounting will not be reiterated in the interests of brevity.

With the bungee cords 106 and 108 connected as just described, the normal contraction of the cords will tend to pull the collapsible hose 24 forward toward the end of the guide tube assembly oriented closest to the building entrance, i.e., so that the collapsible conduit is at the ready position. When the vehicle is backed into the building, such that the upper end 16 of its exhaust stack 14 engages the collapsible conduit 24, the continued movement of the vehicle back into the building causes the conduit to collapse toward the rearward end of the guide tube 22, thereby stretching the bungee cords 106 and 108 about the pulleys 124.

As exhaust fumes are emitted from the exhaust stack 14, they are conveyed through collapsible hose 24 and into vent assembly 42 by means of the elbow 38 and the vent hose 40. The vent assembly 42, while shown mounted on the roof, can alternatively be mounted through a wall or on a wall, depending upon the application. Moreover, the vent hose 40 need not extend through an opening in either the roof or a wall of the structure, but instead may terminate at any fixed duct-work within the building, so long as that duct-work is in communication with a vent assembly constructed in accordance with this invention mounted at any suitable location.

The vent assembly 42 basically comprises a housing 130 mounted on the roof (or ceiling), an electrically operated exhaust fan 132, the heretofore identified control signal receiver 30, an exhaust fume pressure-sensing subsystem (not shown), and a solenoid operated damper assembly 134. The vent means housing 130 houses the exhaust fan 132 and also includes an outlet or chimney 136 at the top end thereof and through which the exhaust fumes gain egress to the ambient atmosphere. The exhaust fan is arranged when operated (activated) to draw the fumes from the collapsible hose 24 through the elbow 38 and associated hose 40 to vent them through the chimney 136 to the ambient atmosphere.

The electrically operated exhaust fan 132 is activated in one of two ways. On start-up of the vehicle's engine, with vehicle 12 located within bay 46, the exhaust fan 132 is arranged to be activated immediately. This is desirable because at start-up, while the vehicle's engine is cold, revving is necessary to warm it up and to build up air pressure for the brakes. Such engine revving produces a large amount of exhaust fumes which, if not evacuated immediately, will escape into the building. The quick activation of exhaust fan 132 is accomplished through the use of the control signal transmitter 28 and associated receiver 30. The transmitter 28 is located within the vehicle coupled to the switch of the ignition system 18 or to the master switch (not shown) which provides electrical power to the vehicle and produces and transmits an electrical control signal when either the master switch or the ignition switch is activated. The transmitter 28 can be of any suitable construction. One particularly effective device is the Linear Alert Digital Security Transmitter, Model No. D-30, manufactured by Linear Corporation of Carlsbad, Calif. The control signal receiver 30 is mounted on (or in) the vent assembly housing 130 and is arranged to receive the transmitted signal from the transmitter. While the receiver 30 is shown mounted on the vent housing 130 it should be understood that it can be located at any convenient position in the building 10 such as in the attic or on the roof. The receiver can also be of any suitable construction, e.g., the Linear Alert Single-Channel Digital Security Receiver, Model No. D-67, also manufactured by Linear Corporation.

The transmitter transmits or broadcasts a low power electrical control signal via an associated antenna 138 to the receiver 30 when the vehicle's master switch or starter button(s) is(are) momentarily pressed in order to start the vehicle's engine. The receiver 30 includes an antenna 140 which is arranged to sense the broadcast low power electrical control signal from transmitter and activate exhaust fan 132 via associated conductors 144. This causes the exhaust fan to be energized, so that it starts rotating, whereupon the fumes are vented to the ambient atmosphere.

Immediate activation of the exhaust fan is not as critical when the vehicle enters the building from outside because the vehicle's engine is idling and emitting much less smoke than on start-up. Thus, in this case the exhaust fan 132 is activated by the heretofore mentioned pressure sensing subsystem. The pressure-sensing subsystem is preferably like that disclosed in my U.S. Pat. No. 5,092,228, whose disclosure is incorporated by reference herein. Thus, the subsystem basically comprises a conventional pressure responsive, electrically operated switch (not shown) mounted in either the elbow 38 or tube 40 and which is arranged to sense the existence of a predetermined pressure therein. The switch activates the exhaust fan whenever the pressure sensed exceeds a predetermined threshold. This causes the fan to be energized, that is, start rotating. The switch is set to actuate the fan at a predetermined pressure level within the hose which is reached when exhaust fumes pass into the hose (as occurs when the vehicle's engine is running)- The switch includes a timer so that it is also arranged to disable the fan, that is, turn the fan off, a predetermined time period after the fan is turned on. This insures that the vehicle's engine is off by the time the fan ceases operation.

The solenoid operated damper assembly 134 is similar to that of the '228 patent and mounted within the venting hose 40. This assembly is normally closed to isolate the interior of the hose (and hence the interior of the building) from the ambient surroundings to insure that heat from the building does not escape through vent hose while also preventing pressure blow-back from the ambient atmosphere outside the building from falsely activating the system, that is, causing the pressure sensor to initiate operation of the fan. The solenoid operated damper assembly is opened in response to activation from the receiver 30, provided via conductors 144, when the vehicle's ignition switch is actuated or from the pressure sensing switch forming part of the pressure sensing subsystem.

In order to assure that the open top 16 of the exhaust stack 14 aligns with and properly enters the front end 48 of guide tube 22 as the vehicle 12 enters the bay 46, a reference line (not shown) is provided, e.g., painted, on the floor of the building alongside the bay. The line is straight and runs from a point near the rearward wall of building, along the floor of bay 46 out front door 50 and along the apron or front driveway of the building. By aligning the vehicle's tires with respect to the guide line as the vehicle enters bay 46, the vehicle 12 will be oriented parallel to the guide tube, thus assuring proper entry of the exhaust stack within the guide tube.

Moreover, the guide tube and the collapsible tube are arranged to be moved laterally, i.e., from side to side, with respect to the guide line. The means for effecting such lateral movement comprises the heretofore identified track and bearing slides 32, 34 and 36, whose construction and operation will be described later. In addition, the front end guide tube is provided with the heretofore identified stack entrance guide assembly 44. That assembly 44 is shown best in FIG. 4 and basically comprises an open bracket ring 146, a pair of angled rods members 148 and a pair of brace members 150. The open bracket ring, the angled rod members and the brace members are all formed of any suitable heat resistant material, e.g., steel. The open bracket ring 146 is fixedly secured to the outer surface of guide tube 22 near its open front end 48 using any suitable means for attachment, e.g., flathead screws and associated nuts 66. The rods are fixedly secured to the open bracket ring by welding to form a V-shaped channel portion 152 leading to a linear channel portion 154 communicating with the slot 56 at open front end of the guide member. The brace members 150 are welded between the angled portions of the rod members 148 to give them added rigidity.

The V-shaped channel 152 and the communicating linear channel portion 154 serve to receive the upper portions 16 of the stack 14 when the vehicle is brought into the building and to guide the stack into the guide tube slot 56. In particular the V-shaped portion 152 of the channel first receives the upper end of the stack, even if the stack is not axially aligned with the slot 56 in the guide tube when the vehicle is moved into the bay. The continued movement of the vehicle further into the bay causes the engaged stack portion to slide first along the angled portion of angled tube member 148. This action has the effect of causing the entire length of guide tube 22 to move along the track slides 32 and 34 and the bearing slide 36 (to be discussed below) in a lateral direction with respect to the guide line so as to align the guide tube 22 with the exhaust stack. The continued movement of vehicle 12 into the bay then causes the engaged stack to move into and along the straight portion of angled rod members, i.e., the portions forming the linear channel 154, toward the open end of the slot 56. This action has the effect of automatically shifting and orienting the open front end of guide tube 22 with respect to the open end 16 of the stack 14. Further movement of the vehicle into the bay causes the outlet opening of the stack 16 to make contact with the front ring 98 at the free end of the collapsible hose 24. As the vehicle 12 moves further into bay, and stack portion 16 enters and travels through the slot 56, while the front ring 98 remains in contact with the open end of the exhaust stack, and the collapsible hose begins to collapse to the retracted position.

As shown in FIGS. 4 and 6, the track slide 34 is preferably formed of square tubing 156 of any suitable material, e.g., steel unistrut. The track slide 32 is of identical construction to track slide 34. Each track slide extends perpendicular to the longitudinal axis of the guide tube 22 and to the guide line on the floor of the bay. Each has a channel 158 or slot extending the length of the tubing in the bottom wall thereof for supporting a small trolley 160 to roll therealong. The trolley basically comprises a base 162 from which a vertically oriented web portion 164 projects upward through the track's channel 158. The web includes an opposed pair of rollers 166 for rolling along the inside surface of the bottom wall of the track on either side of the channel. It should be readily apparent to those skilled in the art that any other form of track/rollers may be utilized to effect the lateral movement of the hollow guide tube 22 so as to align its open front end 48 with open top end 16 of exhaust stack 14.

The bearing slide 36 serves a similar function as the track slides, but is of a somewhat different construction. In this regard as shown in FIGS. 4 and 5, the bearing slide 36 is comprised of a fixed length of square tubing 156 similar to that of the track slides so that it has a channel or slot 158 extending the length of the tubing in the bottom wall thereof. A pair of stationary mounting blocks 168 (FIG. 4) and 170 (FIG. 5) are fixedly secured to the bottom surface of the square tubing by means of bolts 172 (FIG. 5) that attach to spring nuts (not shown) located within the square tubing. Each of the mounting blocks 168 and 170 includes a downward extending web portion 174 containing a horizontal through opening or bore 176. A metal guide rod 178 extends along the tubing through the openings 176 in the two guide blocks. The guide rod is fixedly secured within the openings 176 in the mounting blocks by a bolt 158 (FIG. 5).

A sliding block 182 is mounted on the guide rod to slide therealong. The sliding block serves to mount the support bracket 62 thereon. To that end the sliding block 182 includes an opening having a bearing sleeve 184 fixedly secured therein and through which the guide rod 178 extends. Thus, the sliding block can slide back and forth along the rod 178 between the stationary mounting blocks 168 and 170 so as to effect lateral movement of guide tube 22. The sliding block includes a flange 186 having a pair of holes through which bolts 188 extend to fixedly suspend a plate 190 therefrom. The plate 190 includes a hole 192 through which a bolt 194 extends to suspend the support bracket 62 (and hence the guide tube 22) therefrom. The bolt 194 serves as a pivot to enable the open end 48 of the guide tube to rotate slightly about the axis of the bolt, if necessary, when the upper end of the exhaust stack is received therein.

When the vehicle 12 moves out of building 10, it is important that the guide tube 22 recenters itself (moves back to the original position it occupied before the vehicle entered the building) so that its open free end will be ready to receive the open upper end of the stack when the vehicle returns into the bay. In order to accomplish the centering of the guide tube, a pair of centering bungee cords 196 (FIGS. 4 and 5) of approximately equal length are provided. One cord 196 is connected between an eyelet 198 in the mounting block 168 and a similar eyelet 200 on the slide block 182. The other bungee cord 196 is connected between the eyelet 200 on the sliding block 182 and an eyelet 202 on the mounting block 170. The two bungee cords are each of the same length as the distance between the eyelets 198, 200 and 202 when the sliding block is centered so that the sliding block, and hence the guide tube 22 suspended therefrom, are normally centered along the rod 178, i.e., it is in a neutral position with respect to the bay ready to accept the exhaust stack within the guide tube. As will be appreciated by those skilled in the art, once the vehicle is driven out of the building so that its exhaust stack leaves the guide tube, the normal contraction of either of the centering bungee cords will tend to pull the guide tube back along the rod to the centered neutral position.

Without further elaboration the foregoing will so fully illustrate my invention that others may, by applying current or future knowledge, adapt the same for use under various conditions of service.

We claim:

1. An exhaust fumes distribution system for use within a structure adjacent to a space in which a vehicle having an engine coupled to a vertically oriented, open ended, exhaust stack is to be located to automatically attach/detach to the open end of said stack to discharge exhaust fumes from said vehicle out of said structure, said exhaust fumes distribution system comprising:

(a) actuatable venting means arranged when actuated to vent fumes out of said structure;

(b) elongated guide tube having a hollow interior and a slot extending therealong and in communication with said hollow interior, said guide tube having a longitudinal axis and being mounted horizontally above said space so that said slot extends parallel to said axis from a first position adjacent an entrance to said structure to a second position within said structure remote from said entrance, said slot enabling said stack to be extended therethrough so that said open end is within said hollow interior;

(c) collapsible conduit means located within said elongated guide tube means, said collapsible conduit means being coupled to said venting means and having an end portion including an inlet opening, said conduit means being biased into an extended position within said guide tube means so that said inlet opening is located adjacent said first position to receive said open end of said stack therein, said conduit being collapsible whereupon said open end of said stack remains within said inlet opening in said conduit means when said vehicle is moved in said structure from said first position to said second position; and (d) actuating means for actuating said venting means, whereupon said venting means vents fumes within said stack through said conduit means out of said structure.

2. The system of claim 1 wherein said vehicle includes an electrical switch, and wherein said actuating means is responsive to the operation of said electrical switch.

3. The system of claim 2 wherein said actuating means comprising transmitter means, receiver means, and switch means, said transmitter means being coupled to said electrical switch of said vehicle for transmitting an electrical signal when said electrical switch is actuated, said receiver means receiving said electrical signal and causing said switch means to operate in response thereto, whereupon said switch means actuates said venting means.

4. The system of claim 3 wherein said transmitter means transmits said electrical signal through the air.

5. The system of claim 1 wherein said guide tube means is slidable in directions transverse to said longitudinal axis.

6. The system of claim 1 wherein said guide tube means includes a open end in communication with said slot and through which said stack passes to enter said slot.

7. The system of claim 6 wherein said guide tube means additionally comprises guiding means for orienting said open end of said guide tube with respect to said stack to facilitate the receipt of said open end of said stack within said inlet opening.

8. The system of claim 7 wherein said guide tube means is slidable in directions transverse to said longitudinal axis.

9. The system of claim 7 wherein said guiding means comprises a pair of extending members mounted on said open end of said guide tube means and forming a channel therebetween into which said stack is guided when said vehicle is moved to said first position.

10. The system of claim 9 wherein said channel is generally V-shaped.

11. The system of claim 10 wherein said guiding means additionally comprises a pair of projections for capturing said stack within said channel.

12. The system of claim 1 additionally comprising biasing means for biasing said conduit means in said first position, said biasing means comprising a resilient cord located within said elongated guide tube means.

13. An exhaust fumes distribution system for use within a structure adjacent to a space in which a vehicle having an engine coupled to a vertically oriented, open ended, exhaust stack is to be located to discharge exhaust fumes from said vehicle out of said structure, said vehicle having an electrical switch coupled to said engine, said exhaust fume distribution system comprising:

(a) actuatable venting means arranged when actuated to vent fumes out of said structure;

(b) conduit means coupled to said venting means and having a portion including an inlet opening to receive said open end of said stack therein; and (c) actuating means for actuating said venting means to vent fumes in said stack through said conduit means out of said structure, said actuating means being responsive to the operation of said electrical switch of said engine.

14. The system of claim 13 wherein said electrical switch is an ignition switch for causing ignition of said engine.

15. The system of claim 13 wherein said electrical switch is a master electrical switch of said vehicle.

16. The system of claim 14 wherein said actuating means comprises transmitter means, receiver means, and switch means, said transmitter means being coupled to said ignition switch for transmitting an electrical signal when said ignition switch is actuated, said receiver means receiving said electrical signal and causing said switch means to operate in response thereto, whereupon said switch means actuates said venting means.

17. The system of claim 16 wherein said transmitter means transmits said electrical signal through the air.

18. The system of claim 15 wherein said actuating means comprises transmitter means, receiver means, and switch means, said transmitter means being coupled to said master electrical switch for transmitting an electrical signal when said master electrical switch is actuated, said receiver means receiving said electrical signal and causing said switch means to operate in response thereto, whereupon said switch means actuates said venting means.

19. The system of claim 18 wherein said transmitter means transmits said electrical signal through the air.

* * * * *